US006157272A

United States Patent [19]

Kuo et al.

[11] Patent Number: 6,157,272

[45] Date of Patent: Dec. 5, 2000

[54] POWER NETWORK FOR COLLECTING DISTRIBUTED POWERS

[76] Inventors: Mei-Shong Kuo, No. 2. 3 Lane. Kuo-Chung Street., Hsiang-Shan Li.; Ming-Ying Kuo, No. 39, Yu-Min Street. Long-Shan, Social District., both of Hsinchu, Taiwan, 300

[21] Appl. No.: 09/106,273

[22] Filed: Jun. 29, 1998

[30] Foreign Application Priority Data

Jun. 28, 1997 [TW] Taiwan ..... 86109074

[51] Int. Cl.[7] ..... H01P 5/12

[52] U.S. Cl. ..... 333/100; 333/124; 333/125; 333/136

[58] Field of Search ..... 333/100, 124, 333/125, 136

[56] References Cited

U.S. PATENT DOCUMENTS

| | | | |
|---|---|---|---|
| 3,586,871 | 6/1971 | Seidel | 333/100 X |
| 3,697,895 | 10/1972 | Beck | 333/124 |
| 4,254,386 | 3/1981 | Nemit et al. | 333/136 X |
| 4,556,856 | 12/1985 | Presser | 333/124 |
| 4,785,267 | 11/1988 | Covill | 333/125 |
| 4,885,557 | 12/1989 | Barczys | 333/125 X |
| 5,204,644 | 4/1993 | Dalisda | 333/136 X |
| 5,363,072 | 11/1994 | Sakamoto et al. | 333/125 |
| 5,430,418 | 7/1995 | Blodgett | 333/100 |
| 5,469,129 | 11/1995 | Dydyk | 333/100 X |
| 5,543,762 | 8/1996 | Sigmon | 333/136 X |

FOREIGN PATENT DOCUMENTS

| | | | |
|---|---|---|---|
| 63-59102 | 3/1988 | Japan | 333/124 |

*Primary Examiner*—Benny Lee
*Assistant Examiner*—Barbara Summons
*Attorney, Agent, or Firm*—Rabin & Champagne, P.C.

[57] ABSTRACT

This invention relates to an AC power network for collecting the electric powers of distributed power cells. The AC power network of the invention includes a plurality of AC power cells, a plurality of transmission lines, and at least one resistant load. The AC power network has important properties, such as simple structure and easy setup and maintenance. In addition, when there is non-uniform distribution among AC power cells or some AC power cells are broken down, the AC power network possesses equal potential rings or equal potential planes to eliminating non-uniform distribution without decreasing its power efficiency.

21 Claims, 18 Drawing Sheets

○ : current cell with $I_{s,2} = 3a_1 e^{j(\theta - \frac{\pi}{2})}$

— : TL of length $\frac{\lambda}{4}$ with Zo

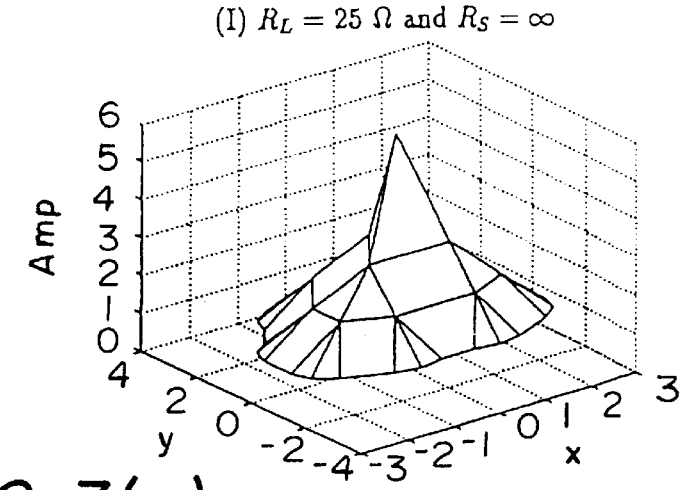
FIG. 3(a) 3D plot of $|V_k|$
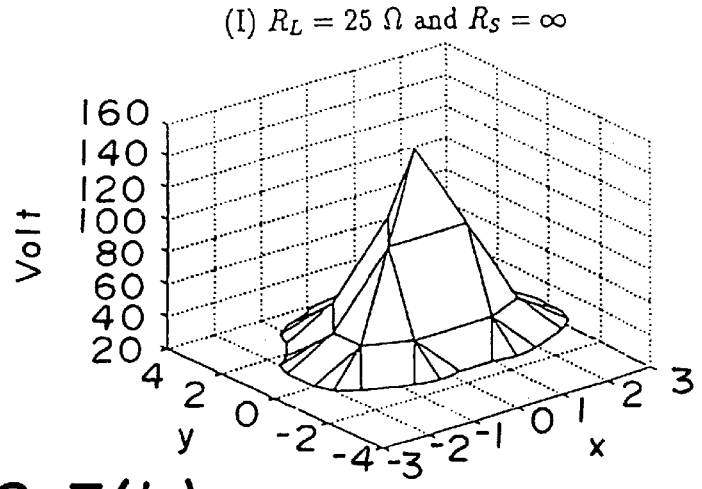
FIG. 3(b) 3D plot of $|I_{r,k}|$
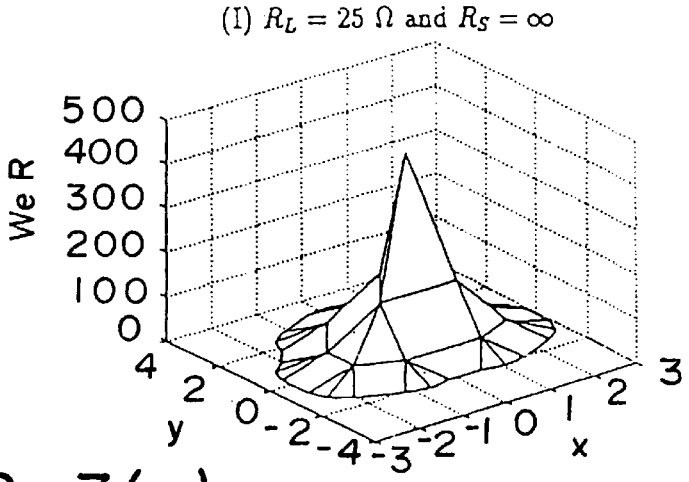
FIG. 3(c) 3D plot of $|P_{r,k}|$

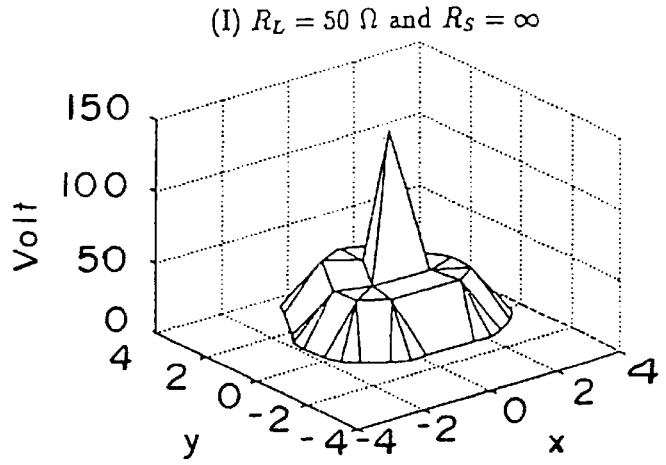
FIG. 4(a) 3D plot of $|V_k|$
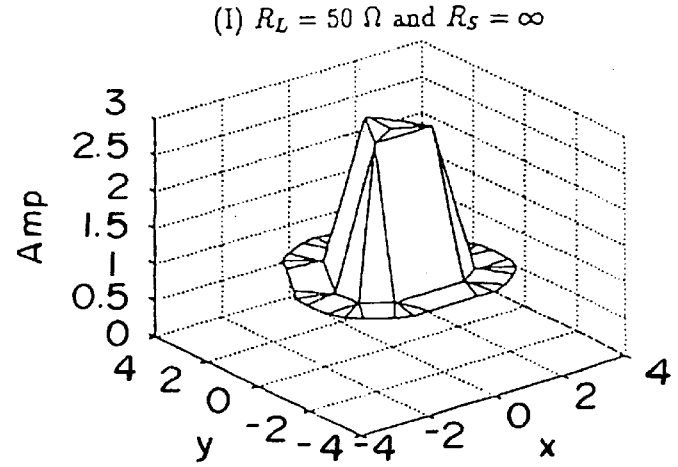
FIG. 4(b) 3D plot of $|I_{r,k}|$
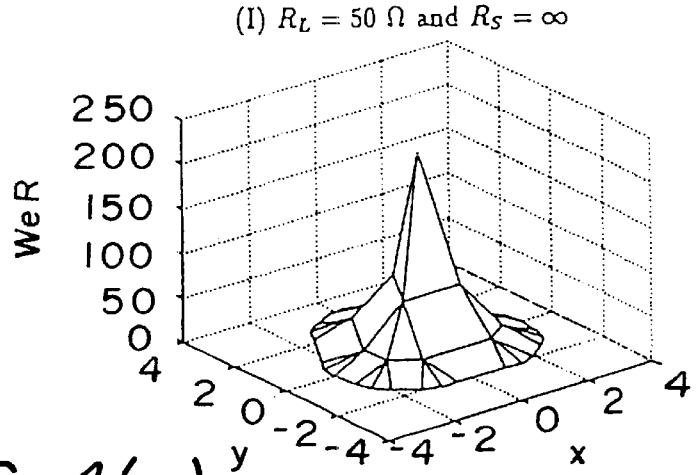
FIG. 4(c) 3D plot of $|P_{r,k}|$ 3D plot of $|V_k|$ 3D plot of $|I_{r,k}|$ 3D plot of $|P_{r,k}|$ FIG. 6(a)
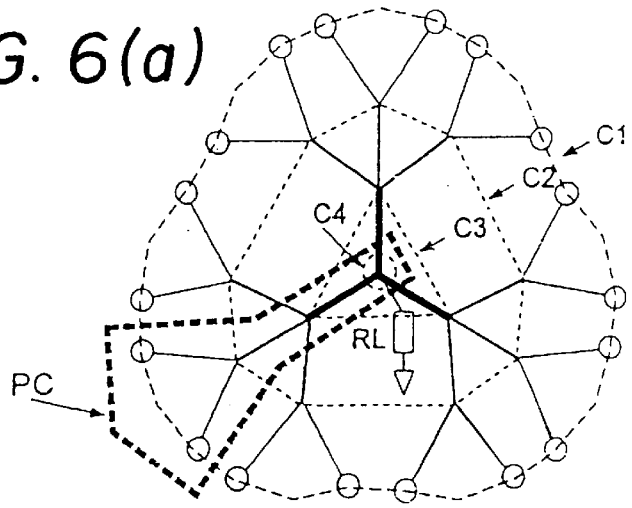
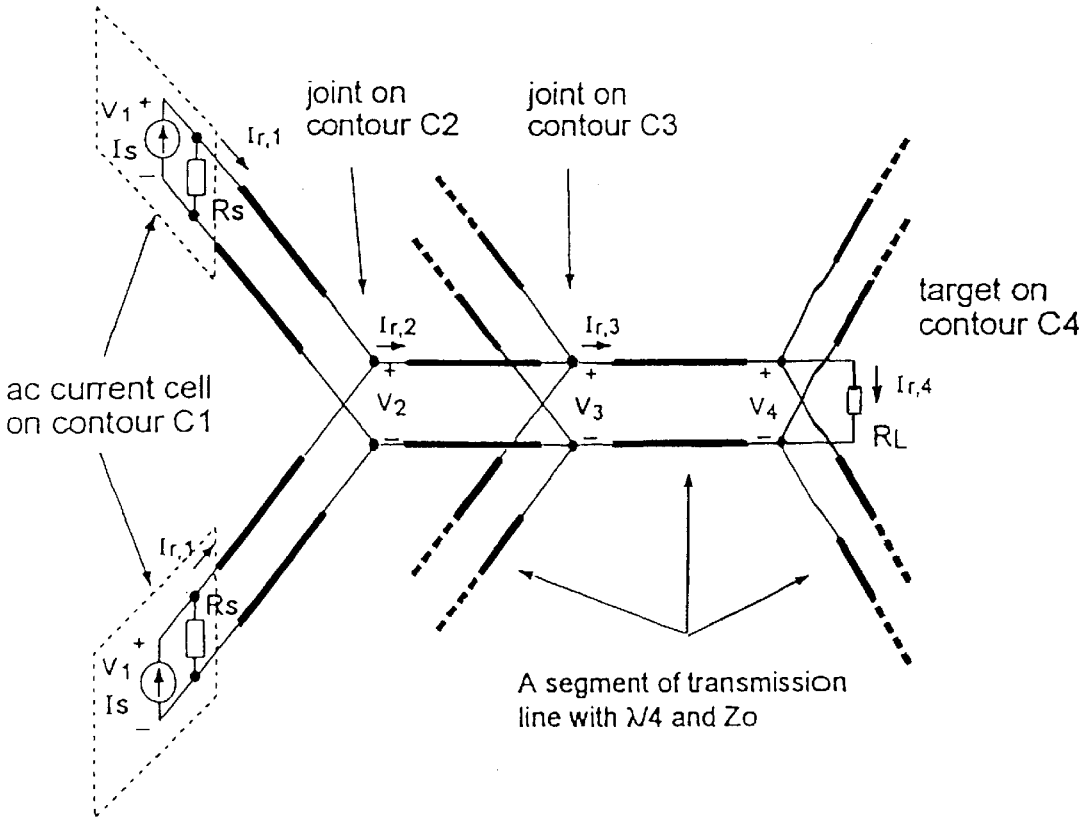
FIG. 6(b)

FIG. 7(a)
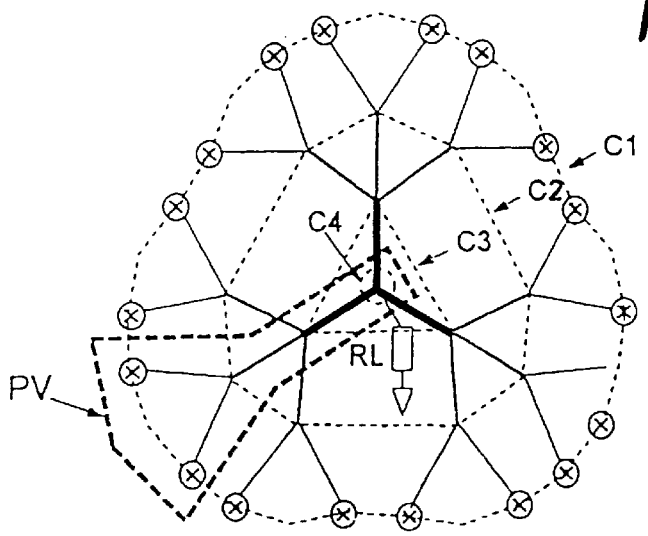
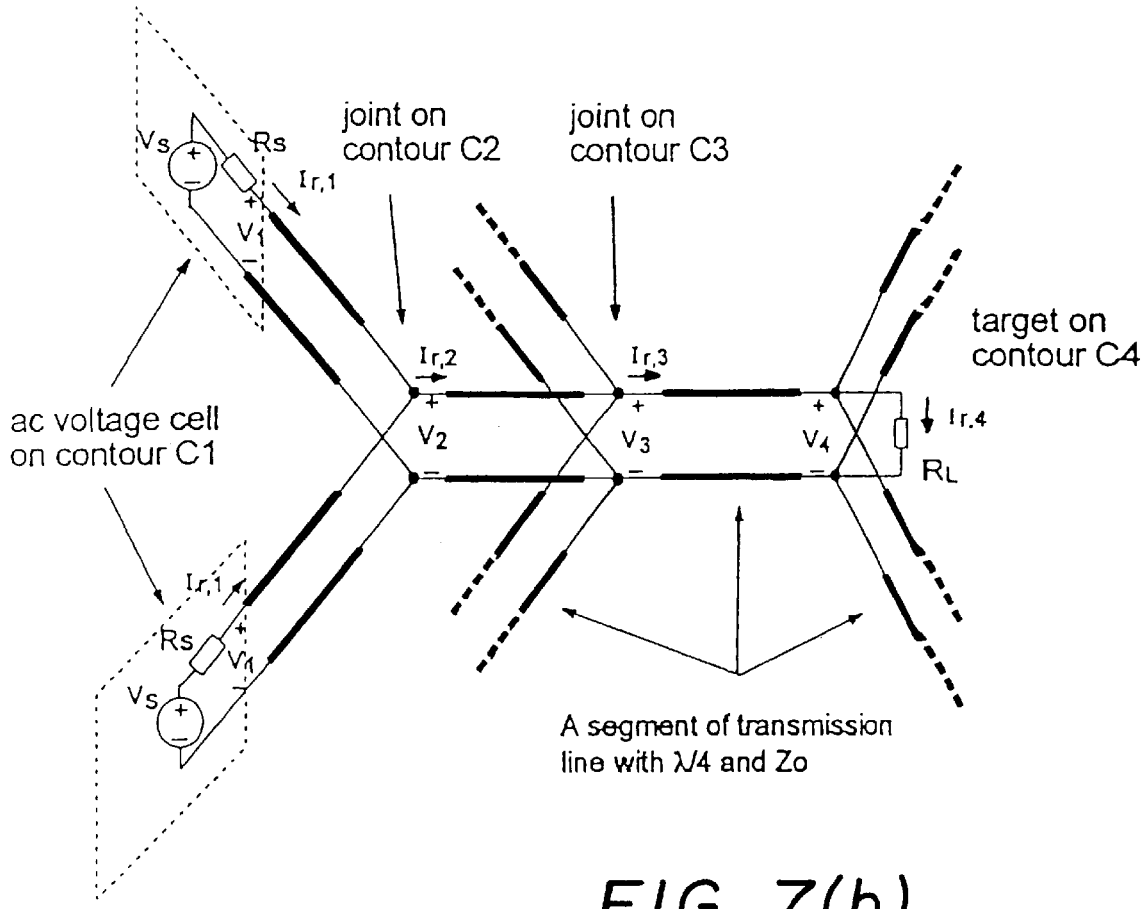
FIG. 7(b)

○ : ac current source

⊗ : ac voltage source

○ : ac current source

⊗ : ac voltage source

POWER NETWORK FOR COLLECTING DISTRIBUTED POWERS

FIELD OF THE INVENTION

This invention relates to an AC power network for collecting the electric power from distributed AC power cells.

BACKGROUND OF THE INVENTION

A lot of power sources are distributed in our environment, such as sunlight, surf, wind. It is an important problem how to collect these energies. Power networks are thus used to resolve this problem.

In a series DC power network of the prior art, when more and more DC power cells are connected to the network, the currents in the network approach to constant values and the power collected by the target load through the network thus approaches a constant. In the same time, the output powers of the DC power cells in the series DC power network of the prior art approach zero. The same problem occurs in a parallel DC power network of the prior art. Series and parallel DC power networks of the prior arts are not suitable for collecting the power of distributed DC power cells. A series-parallel DC power network of the prior art does not induce the above problem when more and more DC power cells are connected to the network, however, it will generate a non-uniform power distribution among the DC power cells thereof. The non-uniform power distribution causes some DC power cells to be inversely charged. In order to prevent the damage of inversely charging DC power cells, diodes are connected in series or parallel to DC power cells. Although the above problems are resolved by using the series-parallel DC power network with diodes, the power efficiency of the network is low when the electric powers of large amount of DC power cells are collected.

SUMMARY OF THE INVENTION

The objective of the invention is to provide an AC power network for collecting the electric power of distributed power cells.

With the problem of the prior art in mind, an AC power network of the invention includes a plurality of AC power cells, a plurality of transmission lines, and at least one resistant load. The AC power network of the invention has important properties, such as simple structure and easy setup and maintenance. In addition, when there is non-uniform distribution among AC power cells or some AC power cells are broken down, the AC power network possesses equal potential rings or equal potential planes to eliminate non-uniform distribution without decreasing its power efficiency.

BRIEF DESCRIPTION OF THE DRAWINGS

Other objects, features, and advantages of the invention will become apparent from the following detailed description of the preferred but non-limiting embodiments. The description is made with reference to the accompanying drawings in which:

FIGS. 3*a* to 3*c* show the simulation results of the tree-structure AC power network with the resistant target load $R_L$=25 Ω ($R_L$<$Z_0$).

FIGS. 4*a* to 4*c* show the simulation results of the tree-structure AC power network with the resistant target load $R_L$=50 Ω ($R_L$=$Z_0$).

FIG. 6*a* is another case of the second embodiment.

FIG. 6*b* shows the real connection of the branches and nodes in the dashed-line contour PC shown in FIG. 6*a*.

FIG. 7*a* is a further case of the second embodiment.

FIG. 7*b* shows the real connection of the branches and nodes in the dashed-line contour PC shown in FIG. 7*a*.

DETAILED DESCRIPTION OF THE INVENTION

First Embodiment:

an AC power network with linear structure.

Figure 1:
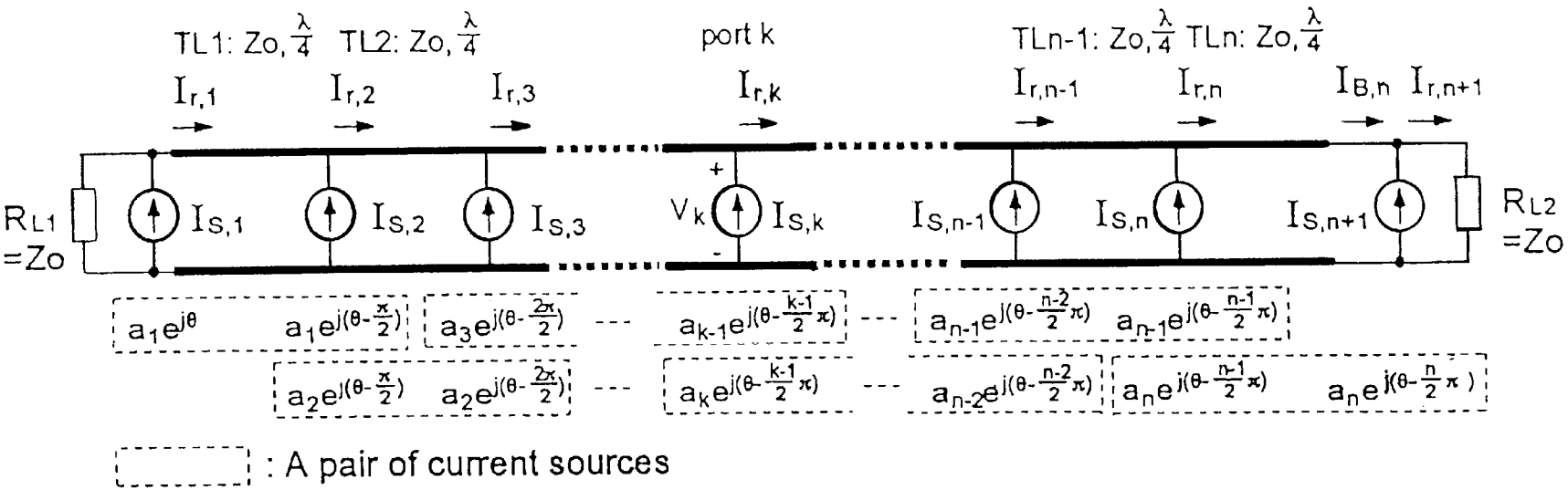
FIG. 1 is the first preferred embodiment of an AC power network of the invention.

Please refer to FIG. 1, which is the first preferred embodiment of an AC power network of the invention. The AC power network of the first embodiment includes a plurality of AC current sources with the same frequency, a plurality of quarter-wavelength transmission lines with the same characteristic impedance, a resistant load, and a resistant target load. It is noted that a AC current source can be characterized by a AC current phasor I with a magnitude A and a phase θ denoted as $I=A\cdot e^{j\theta}$ where $A\geqq 0$ is a real number and j represents $\sqrt{-1}$. Each pair of quarter-wavelength transmission lines has the same characteristic impedance $Z_0$ and induces 90° phase delay between both AC phasors respectively connected to its both ends. The AC current sources are linearly connected by the quarter-wavelength transmission lines. Inside the dashed-line rectangule of FIG. 1, the two AC current phasors with the same magnitude and 90 degree phase difference are called a pair of AC current sources. The magnitude of the kth pair of AC current source is denoted as $A_k$. The power network shown in FIG. 1 consists of n pairs of AC current sources linearly connected with quarter-wavelength transmission lines, a resistant load $R_{L1}$, and a resistant target load $R_{L2}$. Hence, the phasor of the kth AC current source can be written as $$I_{S,k} = (A_{k-1} + A_k) \cdot e^{j\left[\theta - \frac{(k-1)\pi}{2}\right]} \quad \text{for } k = 1, 2, \ldots, n+1, \text{ with } A_0 = A_{n+1} = 0. \tag{1}$$

for k=1,2, . . . ,n+1, (1) with $A_0=A_{n+1}=0$. According to the theories of transmission lines and superposition, the AC voltage phasor $V_k$ and AC current phasor $I_{r,k}$ of the kth port of the power network in FIG. 1 can be represented as $$V_k = \sum_{i=0}^{k-1} A_i \cdot Z_0 \cdot e^{j\left[\theta - \frac{(k-1)\pi}{2}\right]} \tag{2}$$

$$I_{r,k} = \sum_{i=0}^{k-1} A_i \cdot e^{j\left[\theta - \frac{(k-1)\pi}{2}\right]} \tag{3}$$

In addition, the output power $P_{S,k}$ and the collected power $P_{r,k}$ of the kth AC current source and the kth port are described as $$P_{S,k} = \frac{1}{2} V_k \cdot I^*_{S,k} = \frac{1}{2} Z_0 \cdot (A_{k-1} + A_k) \cdot \sum_{i=0}^{k-1} A_i \tag{4}$$

$$P_{r,k} = \frac{1}{2} V_k \cdot I^*_{r,k} = \frac{1}{2} Z_0 \cdot \sum_{m=0}^{k} A_m \cdot \sum_{i=0}^{k-1} A_i = \sum_{m=1}^{k} P_{S,m} \tag{5}$$

where the * denotes the complex conjugate operation. It is obvious that the output power efficiency of every AC current source is 1, the collected power at the resistant target load $R_{L2}$ is maximum, and the collected power at the resistant load $R_{L1}$ is zero.

Second Embodiment:

an AC power network with a tree structure.

According to the equation (5) of the first preferred embodiment, the AC current source near the resistant target load $R_{L2}$ much more is needed to offer higher output power. The AC current source near the resistant target load $R_{L2}$ can be replaced by another linear AC power network of the above embodiment. Hence, the second preferred embodiment of the invention shows an AC power network with a tree structure.

Figure 2:
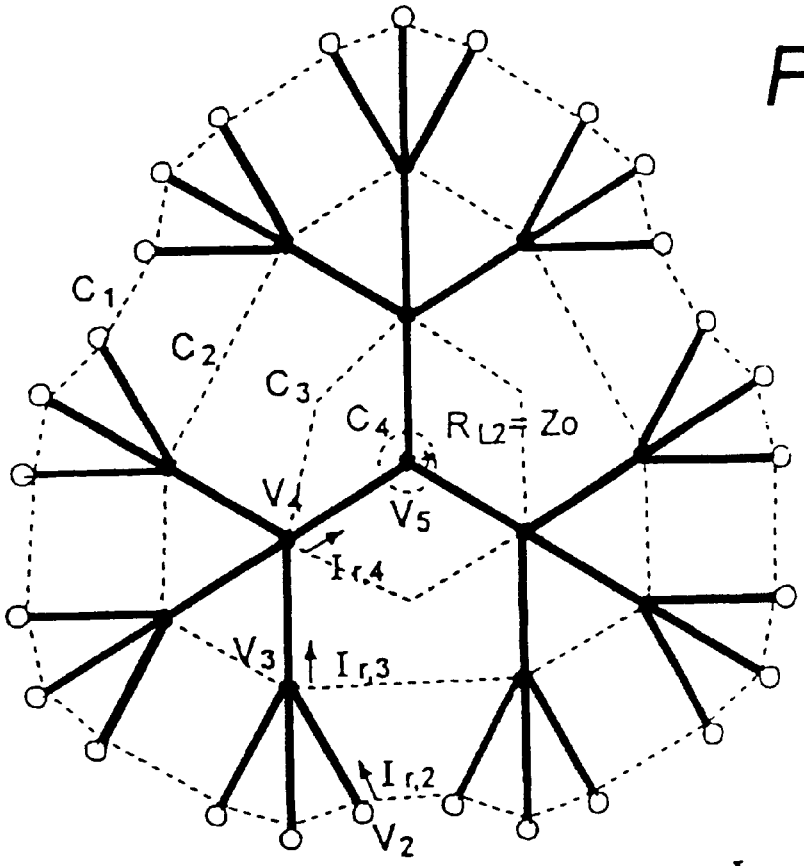
FIG. 2 is the second preferred embodiment of an AC power network with a four-class tree structure of the invention.

The second preferred embodiment of an AC power network of the invention includes a plurality of AC power cells with the same frequency and phasor connected by a plurality of quarter-wavelength transmission lines with the same characteristic impedance, and a resistant target load. In this case, the power cells are current sources. Each pair of quarter-wavelength transmission lines has the same characteristic impedance $Z_0$ and induces a 90 degree phase delay between the two AC current sources connected to both of its ends. The AC power network constructs a tree structure with a root and a plurality of branches and nodes. The resistant target load is the root, a pair of quarter-wavelength transmission lines forms a branch, and AC current sources are the ending nodes. The ending nodes of the AC power network are the leaves of the tree structure, and they are apart from the root with the same number of branches. The nodes excluding the ending nodes denote the locations collecting branches. The nodes with the same number of branches away from the root form a class. The ending nodes form the class one (C1). The nodes in the same class collect the same number of branches. FIG. 2 shows an AC power network with a four-class tree structure. A dashed contour denotes one class, and the leaves of the tree form the class one (C1). The nodes with one branch away from the ending nodes form the class two (C2). Similarly, the classes three (C3) and four (C4) are formed. In FIG. 2, the resistant target load forms C4. The nodes of C2, C3 and C4 collect the same number of branches.

Figure 5A:
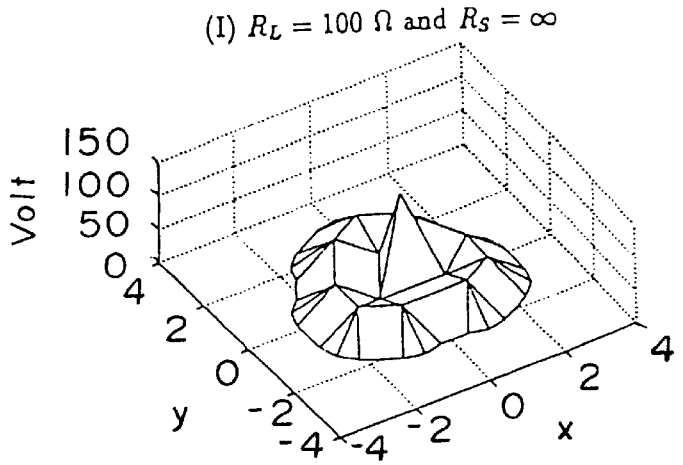
FIGS. 5*a* to 5*c* show the simulation results of the tree-structure AC power network with the resistant target load $R_L$=100 Ω ($R_L$>$Z_0$).
Figure 5B:
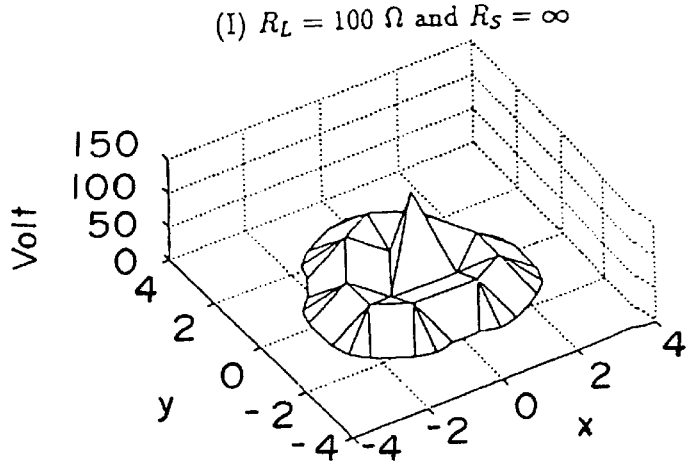
Figure 5C:
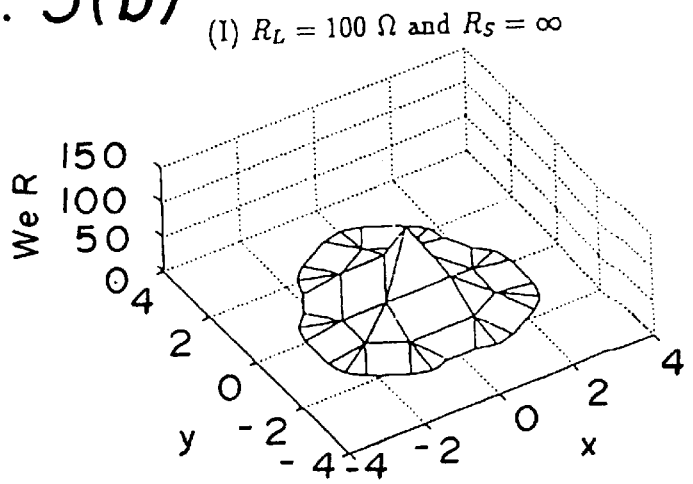

Let the phasor I of each AC current source be $I=1 \cdot e^{j0}$, and the characteristic impedance of each pair of quarter-wavelength transmission lines be $Z_0=50\ \Omega$. It is clear that the AC power network with a tree structure of this embodiment can be seen as an assembly of AC power networks of the first embodiment. Hence, according to the result of the AC power network with the linear structure shown in the first embodiment, the maximum collected power of the network locates at the resistant target load. FIGS. 3, 4, and 5 show the simulation results of the tree-structure AC power network with different values $R_L=25\ \Omega$ ($R_L<Z_0$), $R_L=50\ \Omega$ ($R_L=Z_0$), and $R_L=100\ \Omega$ ($R_L>Z_0$) of the resistant target load, respectively. It is clearly obtained that the more higher power is collected at the port more near the resistant target load, and the maximum power is collected at the resistant target load.

In FIG. 2, the nodes, excluding the ending nodes, collect three branches. FIG. 6*a* shows another case of the embodiment, which the numbers of branches collected by the nodes of different classes are different. It is noted that the result of the case in FIG. 6*a* is the same as the case in FIG. 2. FIG. 6*b* shows the real connection of the branches and nodes in the dashed-line contour PC shown in FIG. 6*a*. In the cases of FIG. 2 and 6*a*, the AC power cells are AC current sources. FIG. 7*a* shows a further case of the embodiment, whose AC power cells are AC voltage sources, and the practical implement of the branches and nodes in the dashed-line contour PC of FIG. 7*a* are shown in FIG. 7*b*.

Third Embodiment:

an AC power network with a tree structure and global equal potential rings.

Figure 8A:
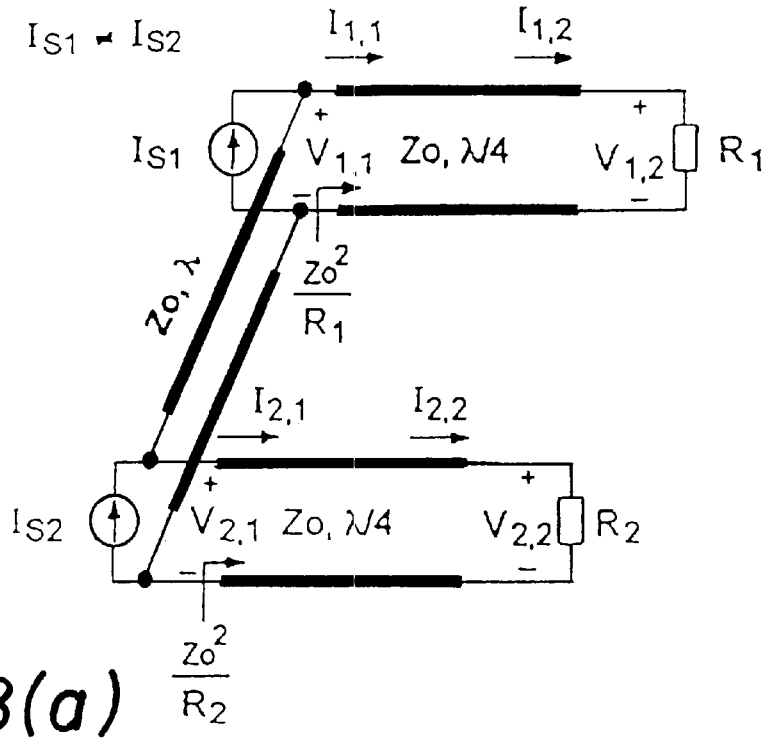
FIG. 8*a* shows a network with two AC current sources, two resistant loads, and three branches.

Please refer to FIG. 8*a*, which shows a network with two AC current sources, two resistant loads, and three branches. Both branches respectively between the AC current source with phasor $I_{S1}$ and the resistant load $R_1$ and between the AC current source with phasor $I_{S2}$ and the resistant load $R_2$ are two pairs of quarter-wavelength transmission lines with impedance $Z_0$, and the branch between both AC current sources is a pair of k-wavelength transmission lines with impedance $Z_0$ and k=1. A pair of k-wavelength transmission lines with impedance will cause k×360° phase delay between both AC phasors respectively connected to both of its ends. According to the transmission-line theory, the AC voltage phasors $V_{1,1}$ and $V_{2,1}$ of both AC current sources $I_{S1}$ and $I_{S2}$ are equal, i.e., $V_{1,1}=V_{2,1}$. In addition, it is obtained that $I_{1,2}=I_{2,2}$. However, the AC current phasors $I_{1,1}$ and $I_{2,1}$ may not be equal, and AC voltage phasors $V_{1,2}$ and $V_{2,2}$ also may not be equal. Since the AC voltage phasors at both ends of the pair of k-wavelength transmission lines as shown in FIG. 8*a* are equal, the pair of k-wavelength transmission lines is called an equal potential ring.

Figure 8B:
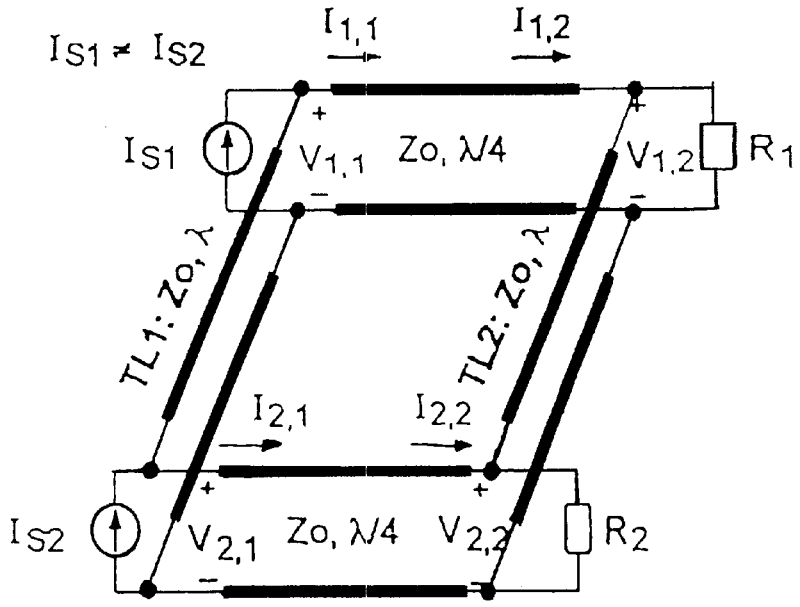
FIG. 8*b* shows a network with two AC current sources, two resistant loads, and four branches.

Please refer to FIG. 8*b*, which shows a network with two AC current sources, two resistant loads, and four branches. Both branches respectively between the AC current source with phasor $I_{S1}$ and the resistant load $R_1$ and between the AC current source with phasor $I_{S2}$ and the resistant load $R_2$ are two pairs of quarter-wavelength transmission lines with impedance $Z_0$, and both branches respectively between both AC current sources $I_{S1}$ and $I_{S2}$ and between both resistant load $R_1$ and $R_2$ is a pair of k-wavelength transmission lines with impedance $Z_0$ and k=1. According to the transmission-line theory, the AC voltage phasors $V_{1,1}$ and $V_{2,1}$ of both AC current sources $I_{S1}$ and $I_{S2}$ are equal, i.e., $V_{1,1}=V_{2,1}$, and so are the AC voltage phasors $V_{1,2}$ and $V_{2,2}$ of both resistant loads $R_1$ and $R_2$, i.e., $V_{1,2}=V_{2,2}$. Consequently, it is obtained that $I_{1,1}=I_{2,1}$ and $I_{1,2}=I_{2,2}$. It is noted that, with the equal potential rings, all AC voltage phasors between each equal potential ring are equal, and so are all AC current phasors between each equal potential ring.

Figure 9B:
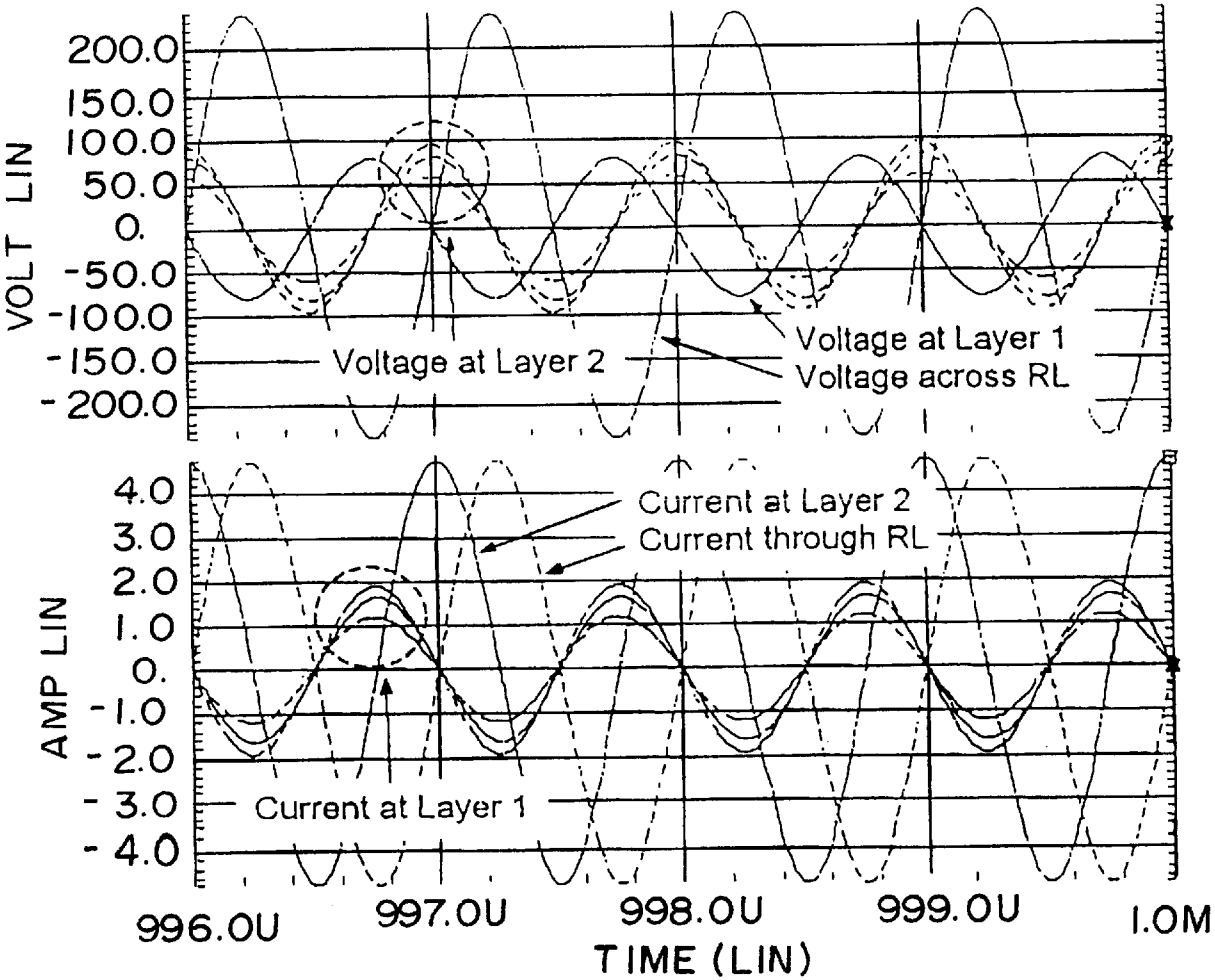
FIGS. 9*a* and 9*b* show an AC power network with three-class tree structure and only one contour of equal potential rings.
Figure 9A:
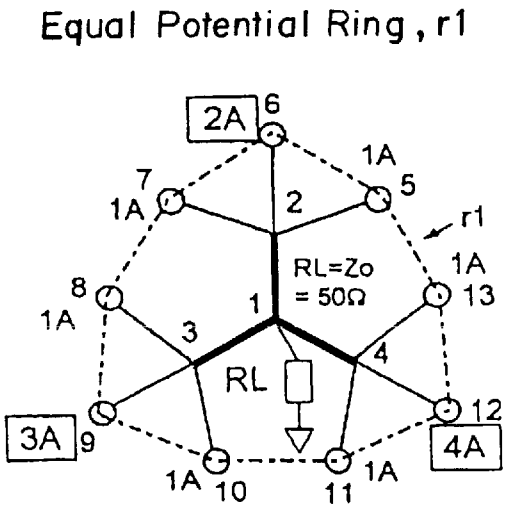
Figure 10B:
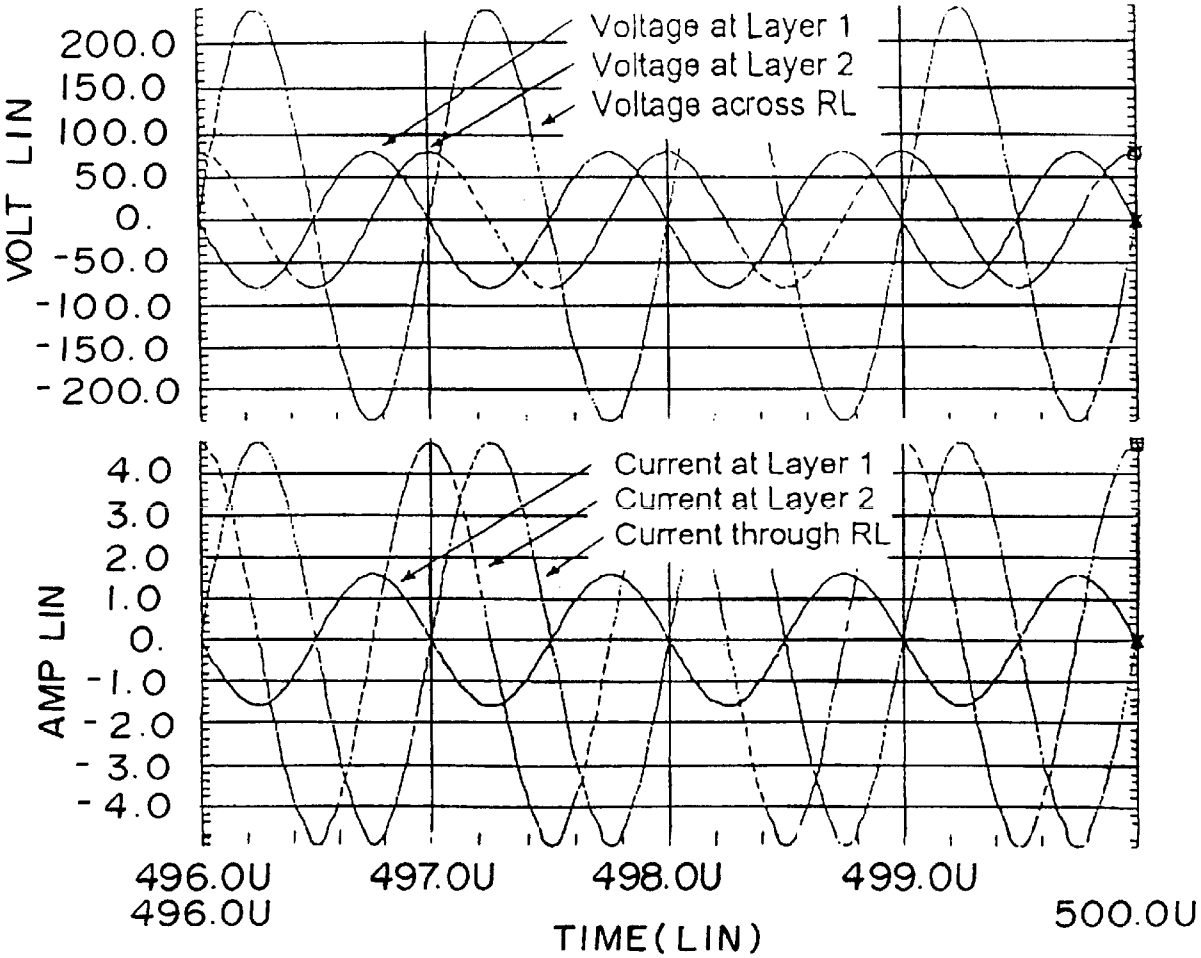
FIGS. 10*a* and 10*b* show an AC power network with three-class tree structure and two contours of equal potential rings.
Figure 10A:
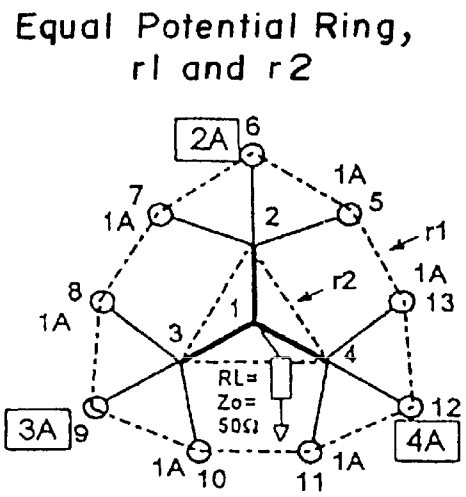

Please refer to FIG. 9, which is an AC power network with three-class tree structure, which includes nine AC current sources at class 1 (C1). The dashed contour at the class 1 (C1) denotes the closed contour (r1) of equal potential rings, which connect all the AC current sources. There are three branches at each node of the AC power network. In addition, three of the nine AC current sources have larger AC current outputs than others'. Hence, the power distribution of the AC network is heavily non-uniform. From the simulation results of the AC network shown in FIG. 9, because there are equal potential rings at class 1, the voltages of the nodes at class 1 are equivalent; however, they are different at class 2. Besides, in FIG. 10, the equal potential rings connect all the nodes at classes 1, and all the nodes at class 2. It is very clear that all the voltages and currents of the nodes at class 1 are equivalent, so as are all the voltages and currents of the nodes at class 2. This means that the power distribution of the AC network is equalized at each class by inserting equal potential rings. In addition, the collected power of the resistant target load is maximum.

Figure 11:
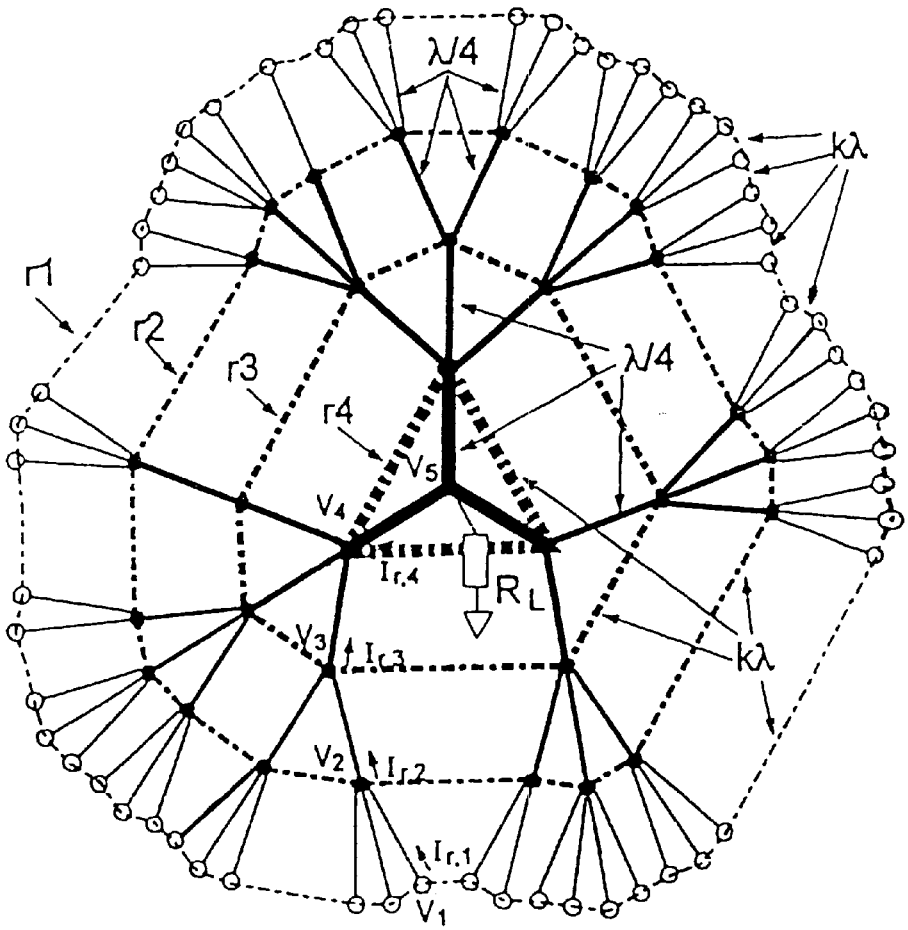
FIG. 11 is the first case of the third embodiment of the invention.
Figure 12:
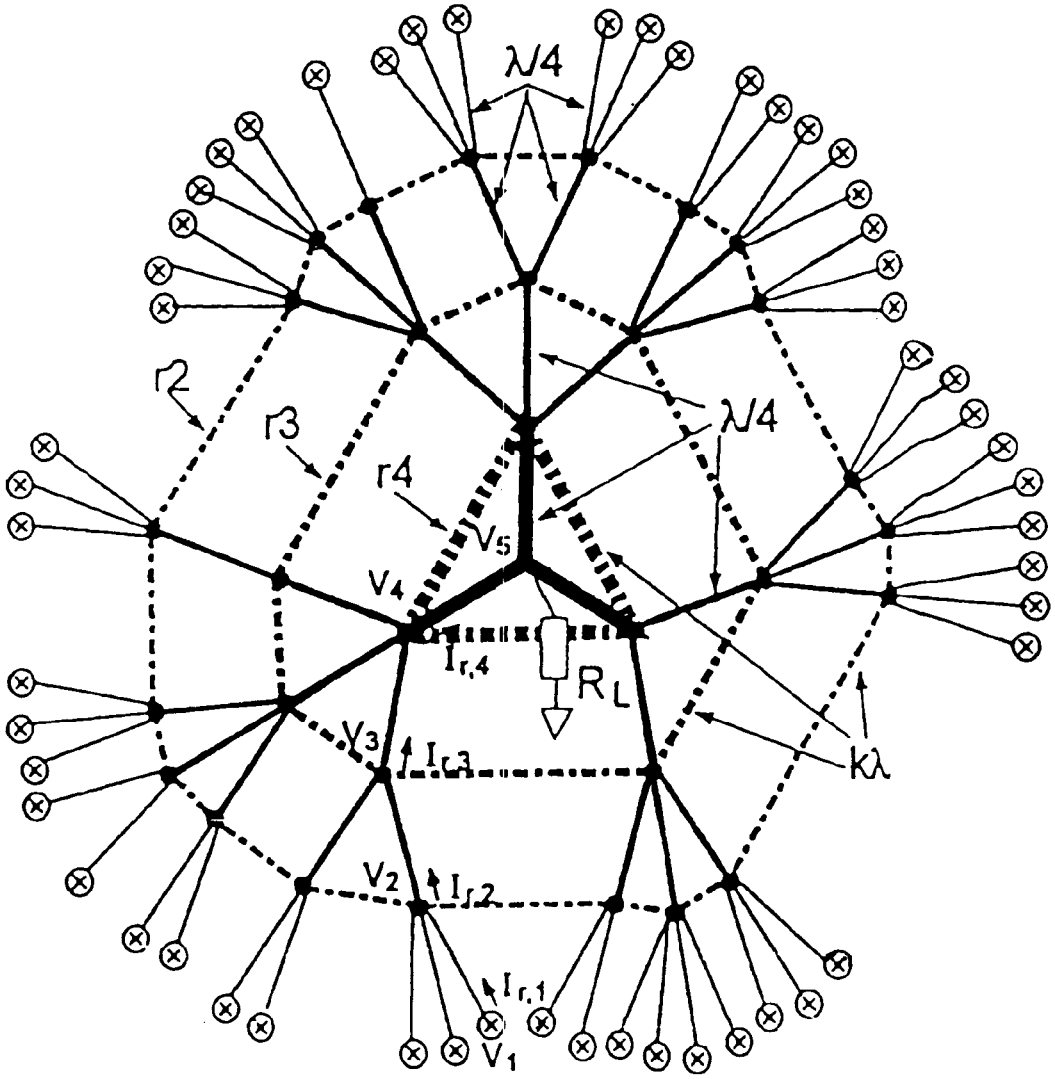
FIG. 12 is the second case of the third embodiment of the invention.
Figure 13:
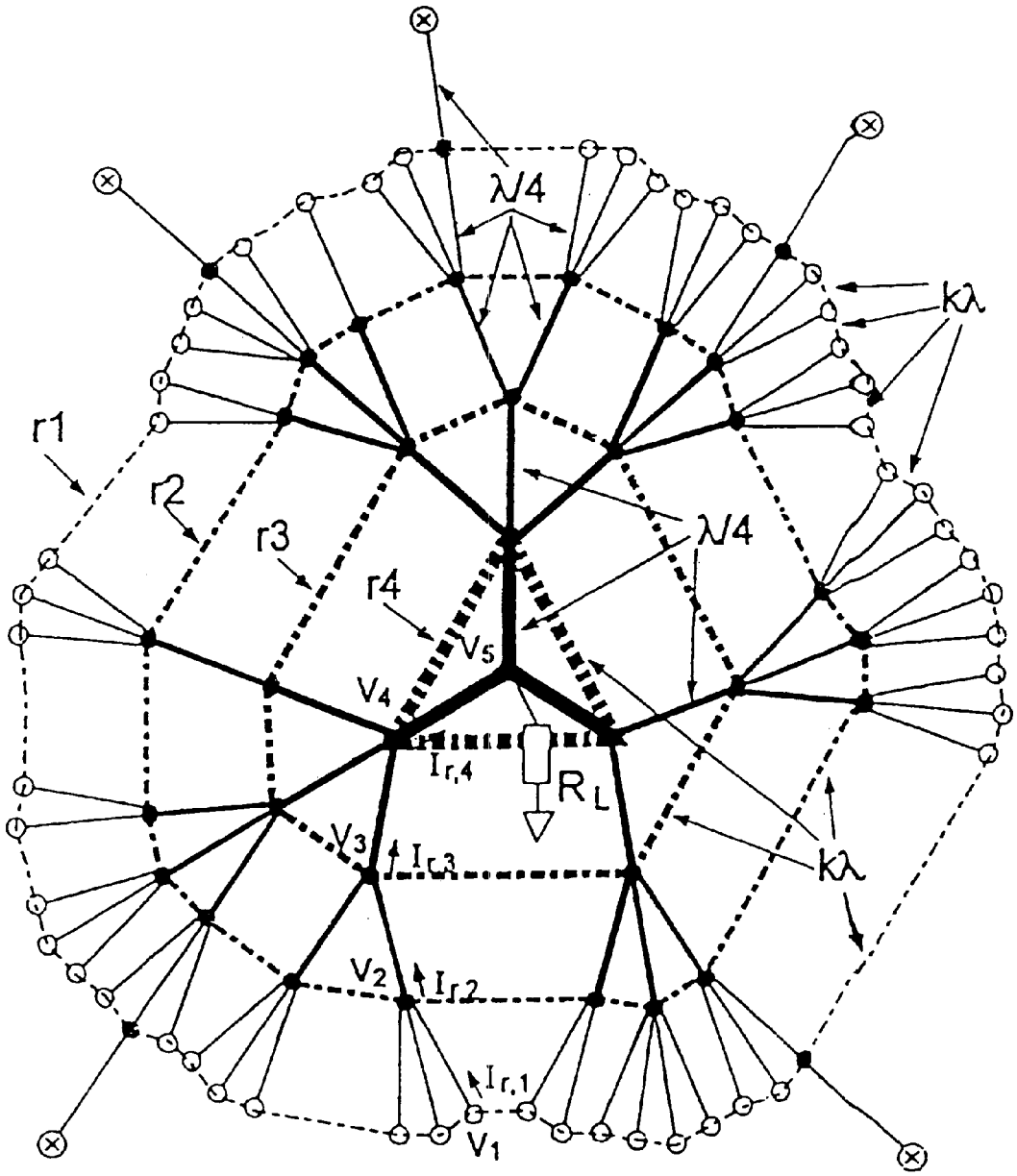
FIG. 13 is the third case of the third embodiment of the invention.

According to the above result, three cases of the third embodiment of the invention are shown in FIGS. 11, 12 and 13, respectively. The first case as shown in FIG. 11 is an AC power network with five-class tree structure, AC current sources, and equal potential rings connecting all nodes of each class (C1, C2, C3, and C4). Every branch of the tree structure consists of a pair of quarter-wavelength transmission lines. The number of branches of the nodes at the class with equal potential rings are not needed to be equal. Since all power cells of the AC network are AC current sources, the first case of the third embodiment is called an current-type AC power network with tree structure and global equal potential rings. Please refer to FIG. 12, which is the second case of the third embodiment. The only difference of the first and second cases is that the AC current sources of the first case are replaced with an AC voltage source and a pair of quarter-wavelength transmission lines. The second case is called an voltage-type AC power network with tree structure and global equal potential rings. In addition, in FIG. 13, the third case of the embodiment is shown. The power cells of the case consist of the AC current source, and the AC voltage source with a pair of quarter-wavelength transmission lines. It is called an hybrid-type AC power network with tree structure and global equal potential rings. It is very important that the equal potential rings, linking all nodes of a class, are not necessary to form a closed contour, and it does not affect their function equalizing the power distribution of the class.

Fourth Embodiment:

an AC power network with tree structure and local equal potential rings.

Figure 14:
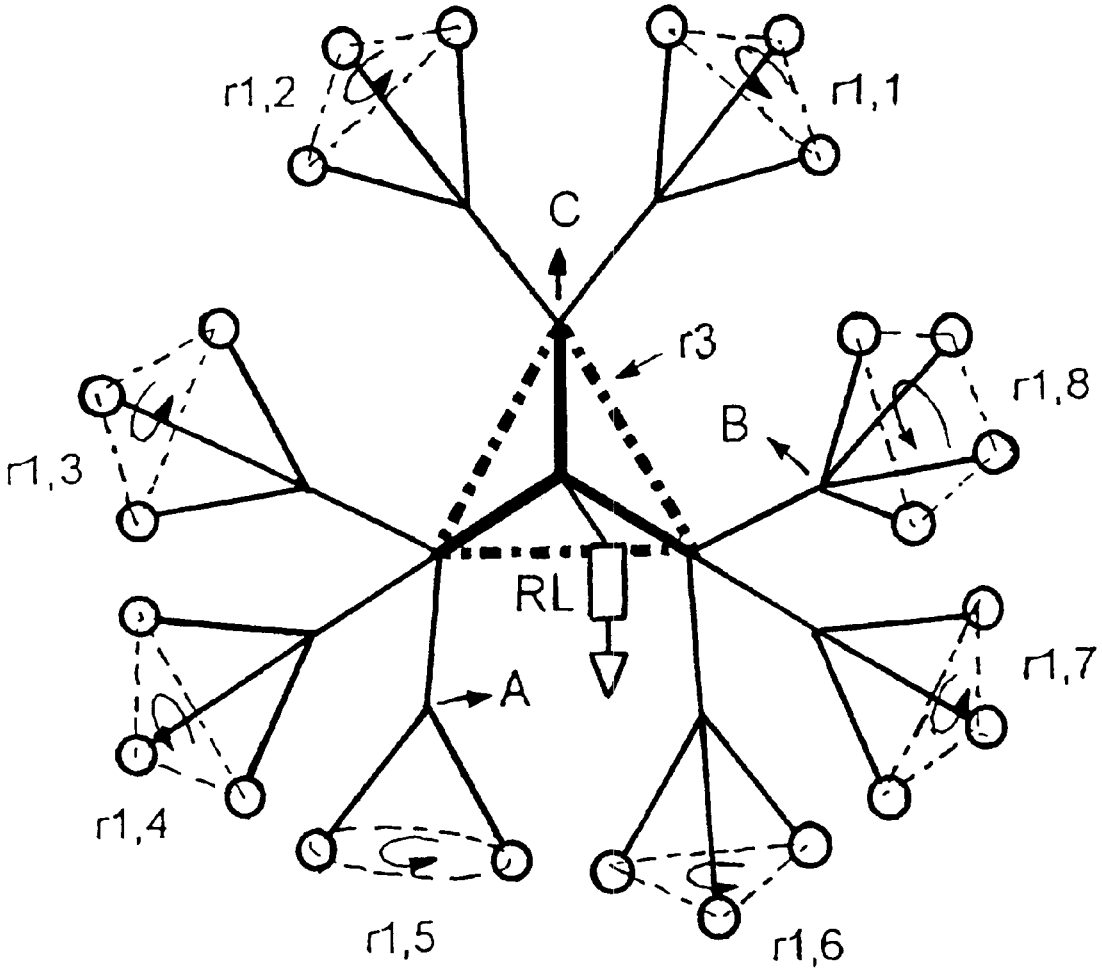
FIG. 14 is the fourth embodiment, an AC power network with a four-class tree structure and local equal potential rings.

In the third embodiment, all classes without the resistant target load have equal potential rings, and the equal potential rings at each class form one contour. In the fourth embodiment, there is at least one contour of equal potent rings at the same class. In FIG. 14, the fourth embodiment of the invention, an AC power network with four-class tree structure and local equal potential rings, is shown. The AC power network includes a plurality of AC power sources, a resistant target load, and a tree structure with branches and nodes. The branches are constructed by quarter-wavelength transmission lines. Nodes at each class are not needed to possess the same number of branches, for example: in the class 2, there are two branches at the node A, there are four branches at the node B, and there are two branches at the node C in the class 3. The ending nodes, i.e. the nodes in the class 1, are the AC current sources whose phasors may have different magnitudes. In the same class (say class k ), these nodes connected to the same node in its preceding class (say class k+1) construct a group of nodes. In the odd classes of this embodiment of the invention, such as class 1 and class 3 etc., every group of nodes has one local contour of equal potential rings connecting all its nodes. For example, the AC current sources of this embodiment shown in FIG. 14 construct eight groups in class 1, and there is a contour of equal potential rings connecting the nodes of every group. In addition, in class 3, there is only one group of nodes, there is only one local contour of equal potential rings. In class 2, there is no equal potential ring.

Every local contour of equal potential rings in class 1 are used to equalize the output powers of the AC current sources in the same group of nodes, which the phasors of these AC current sources may have different magnitudes. The local contour of equal potential rings, in class 3, are used to make the power distribution of the AC power network uniform. In addition, the collected power of the resistant target load is maximum. This embodiment of the invention is called an AC power network with tree structure and local equal potential rings.

Figure 15B:
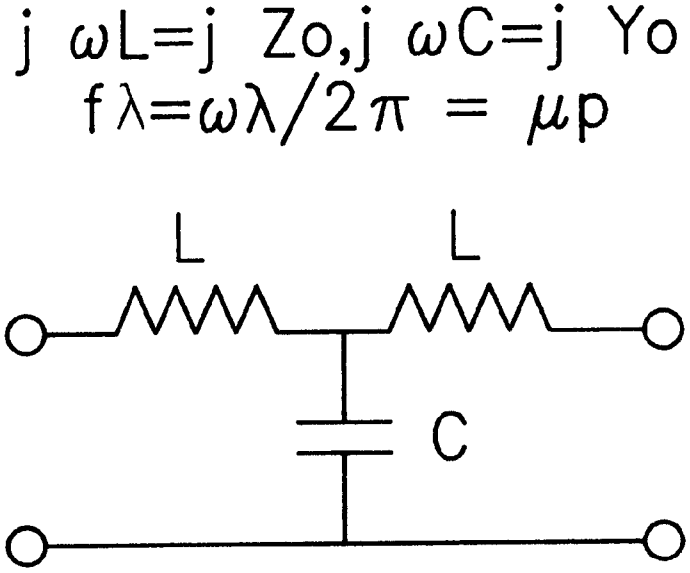
FIG. 15*b* is the other embodiment of a pair of quarter-wavelength transmission lines.
Figure 15A:
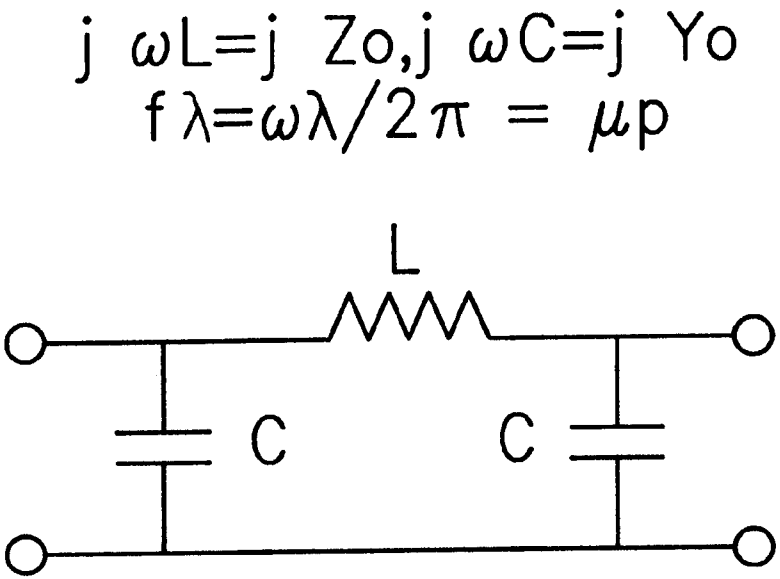
FIG. 15*a* is one embodiment of a quarter-wavelength transmission line.
Figure 15C:
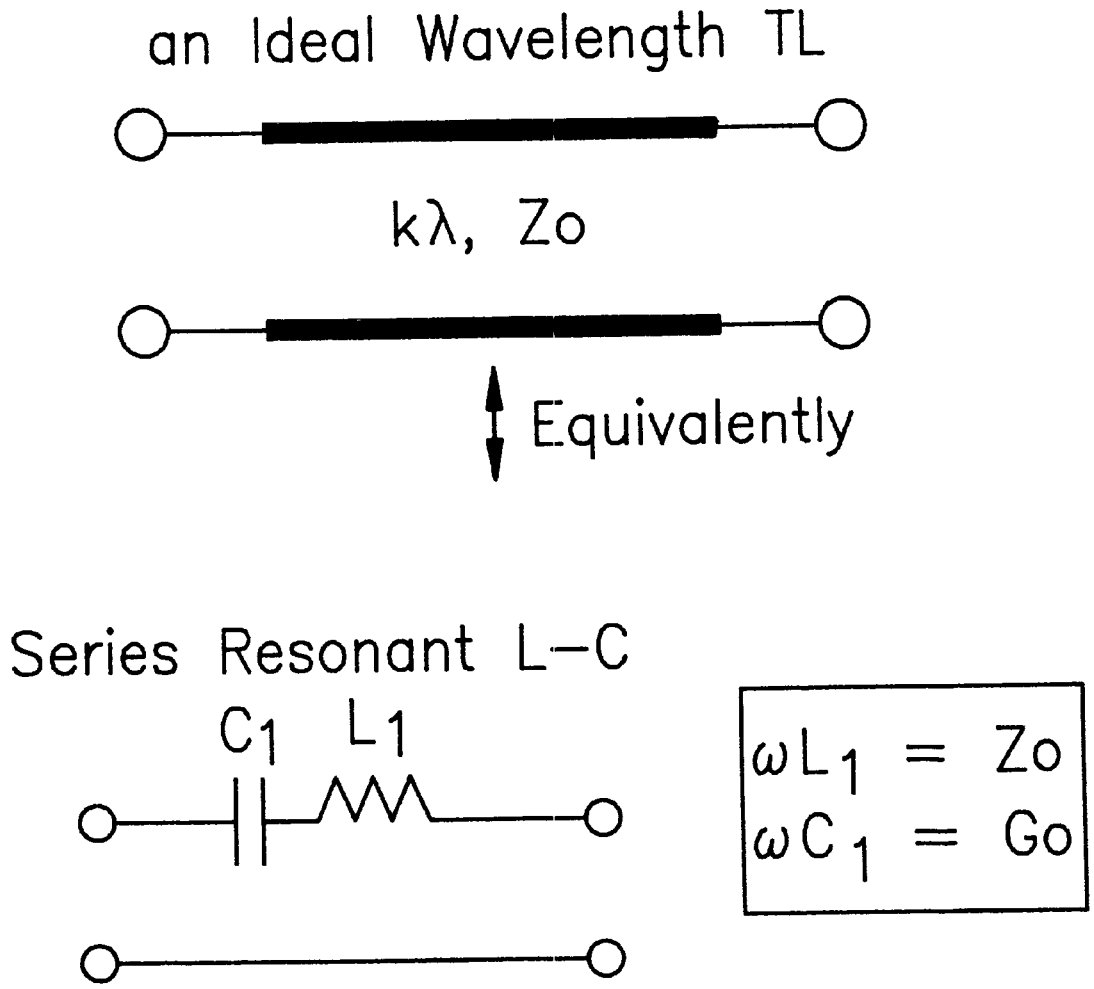
FIG. 15*c* is the embodiment of a pair of k-wavelength transmission lines.

Please refer to FIGS. 15*a* and 15*b*, which are two embodiments of a quarter-wavelength transmission line with impedance $Z_0$. The first one shown in FIG. 15*a* is the lump π-circuit which consists of an inductor with inductance $Z_0/\omega$ and two capacitors with capacitance $1/(\omega \cdot Z_0)$ where ω is the AC power cells' frequency. The both ends of the inductor are connected to one end of each capacitor, and the other ends of both capacitors are linked together. As shown in FIG. 15*b*, the other embodiment is the lump T-circuit, which consists of a capacitor with capacitance $1/(\omega \cdot Z_0)$ and two inductors with inductance $Z_0/\omega$. One end of the capacitor is connected to one end of each inductor. In addition, in FIG. 15*c*, the implement of a pair of k-wavelength transmission lines, which consists of a capacitor with capacitance $1/(\omega \cdot Z_0)$ and a inductor with inductance $Z_0/\omega$. The capacitor and inductor are serially connected.

Fifth Embodiment:

an AC power network with multi-plane structure and equal potential planes.

Figure 16A:
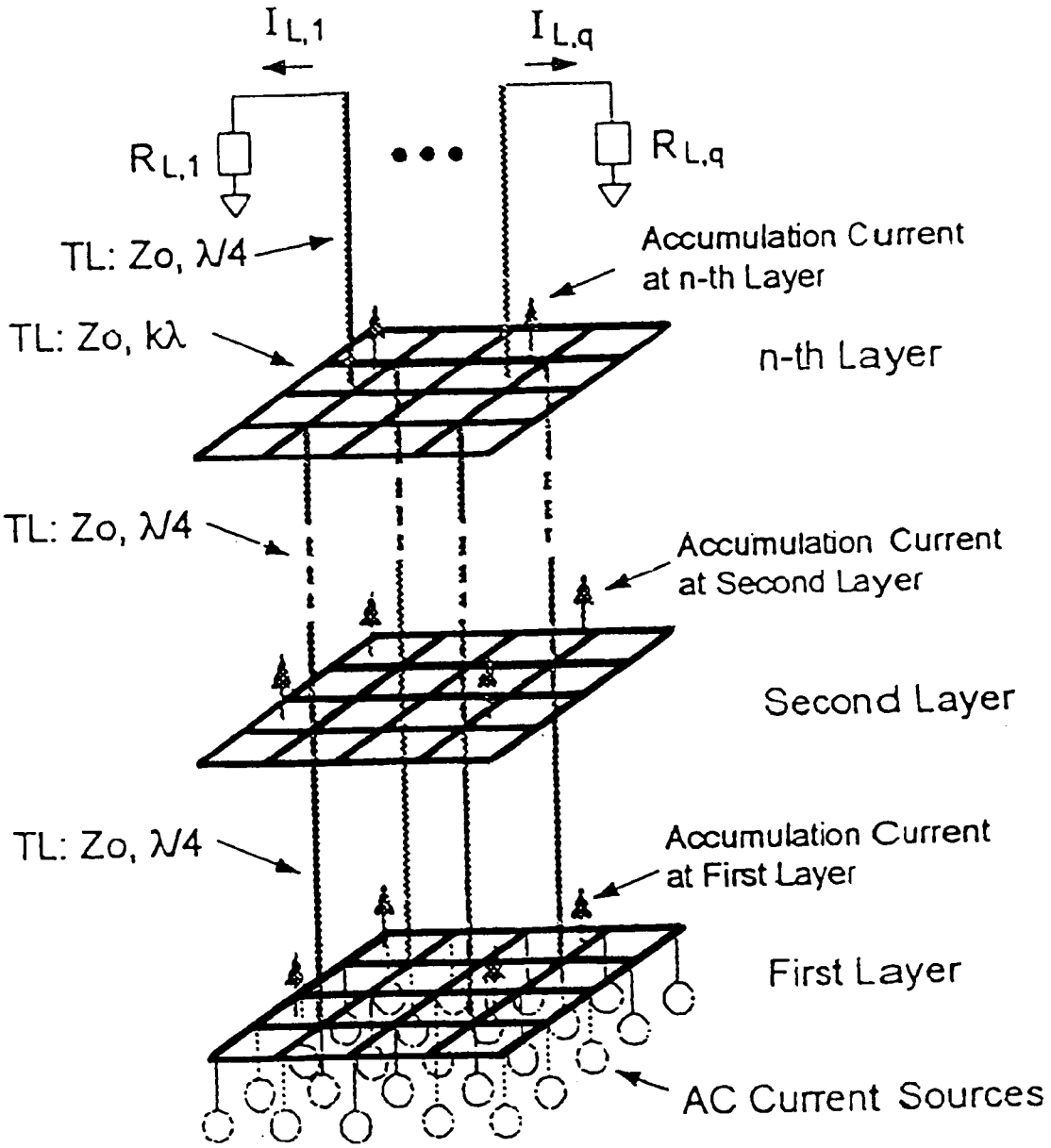
FIG. 16*a* is the first case of the fifth embodiment of the invention.
Figure 16B:
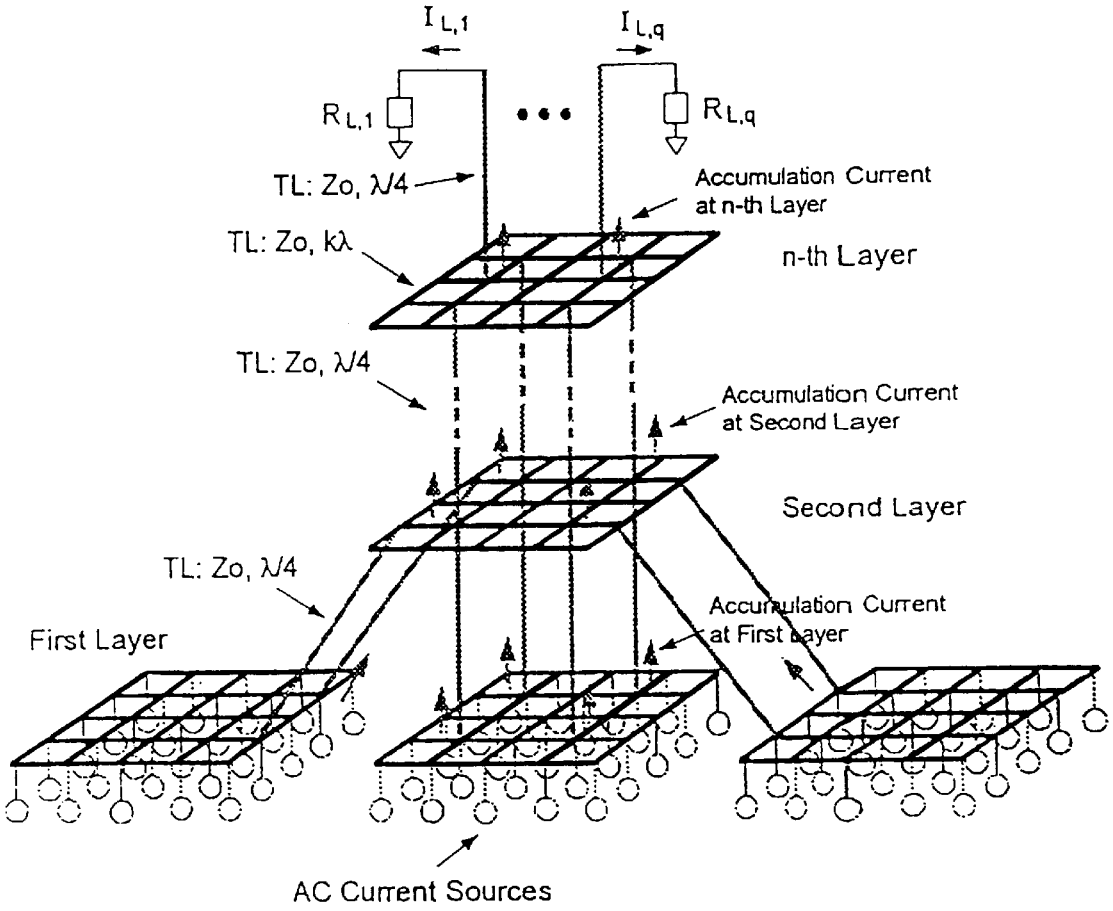
FIG. 16*b* is the second case of the fifth embodiment of the invention.

According to the above results of different equal potential rings, two cases of the fifth embodiment of the invention are shown in FIGS. 16*a* and 16*b*. In FIG. 16*a*, the first case includes at least one resistant target load, a plurality of AC power cells, plural pairs of quarter-wavelength transmission lines, and a plurality of equal potential rings. The equal potential rings construct chess-like equal potential planes whose node's number is not less than the number of the AC power cells. One AC power cell is connected to one node of the fist chess-like equal potential plane. Both corresponding nodes of successive chess-like equal potential planes are connected by a pair of quarter-wavelength transmission lines. The resistant target load is connected to one node of the last chess-like equal potential plane. FIG. 16*b* shows another case of this embodiment, which has a plurality of the first chess-like equal potential planes. The corresponding nodes of the first chess-like equal potential planes and the successive chess-like equal potential plane are connected with pairs of quarter-wavelength transmission lines. Others are similar to the first case. It is clear that, in every chess-like equal potential plane, the power distribution is uniform, and the collected power of the resitant target load is maximum.

It is noted that the AC power networks for collecting the electric powers of amount of distributed AC power cells described above are the preferred embodiments of the present invention for the purposes of illustration only, and are not intended as a definition of the limits and scope of the invention disclosed. Any modifications and variations that may be apparent to a person skilled in the art are intended to be included within the scope of the present invention.

What is claimed is:

1. An AC power network for collecting the electric powers of a plurality of distributed AC power cells, comprising:

a plurality of AC current sources with the same frequency, being arranged in order, the phase difference of every successive AC current sources's phasors being 90°;

a resistant load;

a resistant target load;

and plural pairs of quarter-wavelength transmission lines with the same characteristic impedance, connecting every successive AC current sources, linking the first AC current source and the resistant load, connecting the last AC current source and the resistant target load.

2. The AC power network for collecting the electric powers of a plurality of distributed AC power cells as claimed in claim 1, wherein at least one of said pairs of quarter-wavelength transmission lines consists of a lump π-circuit or a lump T-circuit.

3. The AC power network for collecting the electric powers of a plurality of distributed AC power cells as claimed in claim 1, wherein at least one of said pairs of quarter-wavelength transmission lines is constructed by an electric circuit with phase delay 90°+k×360° where k is a non-negative integer.

4. An AC power network for collecting the electric powers of a plurality of distributed AC power cells, comprising;

a plurality of AC current sources arranged in order, the phase difference of every successive AC current source's phasors being 90°.

5. An AC power network for collecting the electric powers of a plurality of distributed AC power cells, comprising:

a plurality of AC power cells with the same frequency and phase;

plural pairs of quarter-wavelength transmission lines with the same characteristic impedance;

a plurality of equal potential rings;

and a resistant target load;

whereby the AC power cells, the pairs of quarter-wavelength transmission lines, and the resistant target load constructing a tree structure with a root, a plurality of nodes, and a plurality of branches; the AC power cells forming the ending nodes; the pairs of quarter-wavelength transmission lines forming the branches; the resistant target load forming the root; and all nodes of every class of the tree structure, excluding the root, linked by the equal potential rings.

6. The AC power network for collecting the electric powers of a plurality of distributed AC power cells as claimed in claim 5 wherein said equal potential rings of one class of the tree structure form a closed contour.

7. The AC power network for collecting the electric powers of a plurality of distributed AC power cells as claimed in claim 5 wherein said equal potential rings of one class of the tree structure form an opened contour.

8. The AC power network for collecting the electric powers of a plurality of distributed AC power cells as claimed in claim 5, wherein at least one of said pairs of quarter-wavelength transmission lines consists of a lump π-circuit or a lump T-circuit.

9. The AC power network for collecting the electric powers of a plurality of distributed AC power cells as claimed in claim 5, wherein at least one of said pairs of quarter-wavelength transmission lines is constructed by an electric circuit with phase delay 90°+k×360° where k is a non-negative integer.

10. The AC power network for collecting the electric powers of a plurity of distributed AC power cells as claimed in claim 5 wherein said plurality of equal potential rings is constructed by an electric circuit with phase delay k×360° where k is a non-negative integer.

11. The AC power network for collecting the electric powers of a plurality of distributed AC power cells as claimed in claim 5, wherein said AC power cells are constructed by AC current sources or AC voltage sources and that each AC voltage source is connected with a pair of quarter-wavelength transmission lines.

12. An AC power network for collecting the electric powers of a plurality of distributed AC power cells, comprising:

a plurality of AC power cells with the same frequency and phase;

plural pairs of quarter-wavelength transmission lines with the same characteristic impedance;

a plurality of equal potential rings;

and a resistant target load;

whereby the AC power cells, the pairs of quarter-wavelength transmission lines, and the resistant target load constructing a tree structure with a root, a plurality of nodes, and a plurality of branches; the AC power cells forming the ending nodes; the pairs of quarter-wavelength transmission lines forming the branches; the resistant target load forming the root; and all nodes of every class of the tree structure, excluding the root, linked by the equal potential rings.

13. The AC power network for collecting the electric powers of a plurality of distributed AC power cells as claimed in claim 12, wherein at least one of said pairs of quarter-wavelength transmission lines consists of a lump π-circuit or a lump T-circuit.

14. The AC power network for collecting the electric powers of a plurality of distributed AC power cells as claimed in claim 12, wherein at least one of said pairs of quarter-wavelength transmission lines is constructed by an electric circuit with phase delay 90°+k×360° where k is a non-negative integer.

15. The AC power network for collecting the electric powers of a plurality of distributed AC power cells as claimed in claim 12, wherein said plurality of equal potential rings is constructed by an electric circuit with phase delay k×360° where k is a non-negative integer.

16. The AC power network for collecting the electric powers of a plurality of distributed AC power cells as claimed in claim 12, wherein said AC power cells are constructed by AC current sources or AC voltage sources and that each AC voltage source is connected with a pair of quarter-wavelength transmission lines.

17. An AC power network for collecting the electric powers of a plurality of distributed AC power cells, comprising:

a plurality of AC power cells with the same frequency and phase;

plural pairs of quarter-wavelength transmission lines with the same characteristic impedance;

a plurality of equal potential rings;

and at least one resistant target load;

whereby the AC power cells, the pairs of quarter-wavelength transmission lines, the equal potential rings, and the resistant target load constructing a multi-plane structure with a plurality of chess-like equal potential planes and a plurality of nodes on each chess-like equal potential plane with the number of nodes of each chess-like equal potential plane not less than the number of the AC power cells; the chess-like equal potential planes including a last chess-like equal potential plane and at least one first chess-like equal potential plane; the AC power cells linked to the nodes of the first chess-like plane with a pair of quarter-wavelength transmission lines; the equal potential rings forming the branches of each chess-like equal potential plane; the pairs of quarter-wavelength transmission lines linking the corresponding nodes of every two successive chess-like equal potential planes; the resistant target load linked to a node of the last chess-like equal potential plane.

18. The AC power network for collecting the electric powers of a plurality of distributed AC power cells as claimed in claim 17, wherein at least one of said pairs of quarter-wavelength transmission lines consists of a lump π-circuit or a lump T-circuit.

19. The AC power network for collecting the electric powers of a plurality of distributed AC power cells as claimed in claim 17, wherein at least one of said pairs of quarter-wavelength transmission lines is constructed by an electric circuit with phase delay $90°+k\times360°$ where k is a non-negative integer.

20. The AC power network for collecting the electric powers of a plurality of distributed AC power cells as claimed in claim 17, wherein said plurality of equal potential rings is constructed by an electric circuit with phase delay $k\times360°$ where k is a non-negative integer.

21. The AC power network for collecting the electric powers of a plurality of distributed AC power cells as claimed in claim 17 wherein said AC power cells are constructed by AC current sources or AC voltage sources.

* * * * *